US007410932B2

(12) United States Patent
Figueroa

(10) Patent No.: US 7,410,932 B2
(45) Date of Patent: Aug. 12, 2008

(54) SUBLIMATED AND SCREEN-PRINTED APPLIQUÉS

(75) Inventor: Manuel Figueroa, North Miami Beach, FL (US)

(73) Assignee: World Emblem International, Inc., Miami, FL (US)

( * ) Notice: Subject to any disclaimer, the term of this patent is extended or adjusted under 35 U.S.C. 154(b) by 385 days.

(21) Appl. No.: 11/106,821

(22) Filed: Apr. 15, 2005

(65) Prior Publication Data

US 2006/0234015 A1 Oct. 19, 2006

(51) Int. Cl.
*B41M 5/035* (2006.01)

(52) U.S. Cl. ..... 503/227; 8/471; 156/234; 156/240; 427/264; 427/275

(58) Field of Classification Search ..... None
See application file for complete search history.

(56) References Cited

U.S. PATENT DOCUMENTS

| | | | | |
|---|---|---|---|---|
| 4,984,517 | A * | 1/1991 | Doublet | 101/470 |
| 5,411,783 | A * | 5/1995 | Mahn, Jr. | 428/79 |
| 5,681,631 | A * | 10/1997 | Steelman et al. | 428/42.2 |
| 6,261,995 | B1 | 7/2001 | Nakajima et al. | 503/227 |
| 6,703,089 | B2 * | 3/2004 | DeProspero et al. | 428/32.76 |
| 6,787,503 | B2 | 9/2004 | Suh | 503/227 |

* cited by examiner

*Primary Examiner*—Bruce H Hess
(74) *Attorney, Agent, or Firm*—K&L Gates LLP

(57) ABSTRACT

An appliqué and associated method of applying an appliqué an improved sublimated and screen printed image on a substrate of a An improved appliqué suitable for applying a graphic to a material a first printing layer and a second polyurethane layer. The appliqué is cut the graphic imparted thereon and adhered to a garment.

4 Claims, 1 Drawing Sheet

SUBLIMATED AND SCREEN-PRINTED APPLIQUÉS

FIELD OF THE INVENTION

The present invention relates to the application of graphics to the surface of a material, such as for a garment.

BACKGROUND OF THE INVENTION

An appliqué is a decoration or ornament, such as needlework, involving a swath of material known as an appliqué, which is attached to the surface of another material. An appliqué is typically assembled by cutting a piece of a material and attaching it to the surface of another material. Appliqués are usually attached to the surface of a second material by sewing or by the application of pressure and heat through a heat press process. Appliqués may be assembled on most fabrics, and are largely associated with images and designs attached to garments and clothing.

There are other methods besides assembling of appliqués for providing clothing with graphics including, but not limited to, lettering, images, and designs. Sublimation, for example, is a method of applying an image to specially coated ceramics, metals, and polyester cloth. The sublimation process uses sublimation ink, heat, and pressure to bestow a substrate with an image. A heat-sensitive sublimation dye is dissolved in a liquid to print graphics and text and then transferred to special inkjet paper in a process called dye sub transfer. The dye sub transfer and an object with a sublimatable substrate are then placed into a heat press, where pressure and heat are applied to transfer the image to the substrate.

When the heating cycle is completed, the image on the paper has been transferred to the item and has actually become a part of the substrate or surface. Sublimation is typically performed on a polymer or polymer-coated item, such as polyester, as the pores of a polymer are more suitable for integrating the sublimation dye into its substrate. At high temperatures, the solid dyes in the print convert into a gas without ever becoming a liquid. The high temperature also opens the pores of the polymer and allows the gas to enter them. When the item is removed from the heat press, the temperature drops, the pores close, and the gas reverts to a solid state. The image has now become integral with the substrate of the polymer. If the process is performed correctly, the transferred image cannot be removed, unless the actual fibers or coating is damaged.

The sublimation process may be limited because sublimation is more effective on polymeric substrates than on natural materials, such as those made from 100% cotton. Natural fibers and non-coated materials are not as porous as polymer surfaces, so that the dye is disposed on the top of the fabric. Furthermore, the sublimation process has garnered limited results on non-white substrates. This is because the ink used in the sublimation process is actually transparent when sublimated and is more effectively highlighted by a white background.

Screen printing is another method used to provide a fabric or garment with a graphic, such as, but not limited to lettering, an image, or a design. Screen printing consists of three elements: a screen, which is the image carrier; a squeegee; and ink. The screen printing process uses a porous mesh stretched tightly over a frame made of wood or metal. Proper tension is essential in order to ensure accurate color registration on the porous mesh. The mesh is made of porous fabric or stainless steel mesh. A stencil is produced on the screen either manually or photochemically. The stencil defines the image to be printed, which in other printing technologies would be referred to as the image plate.

Screen printing ink is applied to the substrate by placing the screen over the material. Ink with a paint-like consistency is placed on the top of the screen. Ink is then forced through the fine mesh openings using a squeegee that is drawn across the screen, applying pressure and thereby forcing the ink through the open areas of the screen. Ink will pass through only in areas where no stencil is applied, thus forming an image on the printing substrate. The diameter of the threads and the thread count of the mesh will determine how much ink is deposited onto the substrates. Direct screen printing is also limited in that graphics produced by direct process do not transfer well to garments.

There is a need for an improved method of bestowing a sublimation or screen-printed image onto a substrate. There is also a need to develop a process for imparting graphics to a non-white fabric. There is a further need to develop a process for imparting graphics to a fabric where the graphics are high-quality, but are not permanently installed on the fabric.

SUMMARY OF THE INVENTION

Provided herein is an appliqué suitable for applying a graphic to a substrate of a material. The appliqué is comprised of a first layer of a material having a graphic embedded therein, the graphic being printed on the first layer by a method selected from the group consisting of sublimation, screen printing, and combinations thereof. A second layer comprising a urethane is adhered to the first layer. Portions of the first layer and the second layer in which the first layer does not include the embedded graphic are removed by laser cutting.

A method of applying a graphic to a substrate is also provided. The method comprises: i) providing an appliqué comprising a first layer and a second layer of urethane bonded together, ii) applying a graphics operation process to said first layer of said appliqué to imbed graphics therein, iii) cutting said appliqué around said imbedded graphics to remove portions not containing imbedded graphics, and iv) applying said appliqué to said material at an interface with said second layer.

In an embodiment, the cutting is performed by a laser cutter. In another embodiment, the appliqué is applied to the substrate by a thermal adhesion process.

The first layer of the appliqué is comprised of a material selected from the group consisting of polyester, cotton, and mixtures thereof. The graphic is printed or transferred onto the first layer by a method selected from the group consisting of sublimation, screen printing, and combinations thereof. In a non-limiting embodiment, the first layer and second layer may be adhered together by a thermal adhesion process. In a further non-limiting embodiment, the thermal adhesion process involves the addition of pressure to push the first and second layers together. The appliqué may be assembled at a temperature of from about 375 degrees Fahrenheit (° F.) to about 425° F. The appliqué is removable from the substrate to which it is appended, and it is non-permanently applied to a substrate surface.

A substrate of a material with a removably adhered appliqué appended thereto is also provided herein. The appliqué is comprised of a first layer and a second layer, wherein the first layer comprises a first side and an opposed second side. The first side includes a graphic and the opposed second side is adhered to the second layer. The second layer comprises a urethane and is adhered to the substrate.

DETAILED DESCRIPTION OF THE INVENTION

Figure 1:
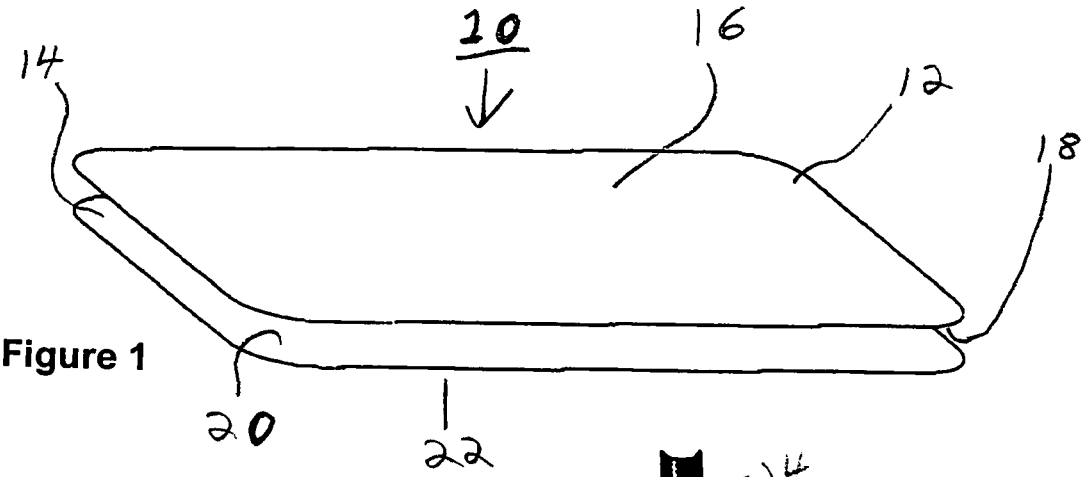
FIG. 1 is a perspective showing the appliqué of the present invention prior to assembly.

As used herein, the term "graphic" refers to any visual image which may be illustrated on a surface including, without limitation, letters, designs and illustrations.

As used herein, the term "urethane" refers to a material comprising polyurethane. As used herein, the term "thermal adhesion process" refers to a method of using heat to adhere objects together. Certain materials are more suitable for a thermal adhesion process including, but not limited to, polymers such as polyurethane, which sinter together with a substrate when placed in contact with a substrate and heat is applied. Pressure may also be applied to facilitate adhesion between these elements. Heat pressing is an example of a thermal adhesion process.

As used herein, the term, "graphics operation process" refers to a process of transferring any type of graphic, as used herein, to a medium suitable for the display of the graphic. Such processes include, but are not limited to, sublimation and screen-printing processes. As used herein, the term "imbedded" refers to graphics on a substrate which are substantially incorporated into the pores of the substrate.

In a non-limiting embodiment, the graphic is transferred or printed on the first layer of the appliqué by a sublimation process. In another non-limiting embodiment, the graphic is transferred to the first layer of the appliqué by a screen process.

Sublimation and screen printing are known in the art. Sublimation refers to a method in which a heat-sensitive sublimation dye is dissolved in a solvent. Any of the well-known sublimation dyes may be used and the dye may be dissolved in solvents such as water on cleaning solution.

The dye in solution prints on inkjet paper specifically designed for this use, and the inkjet paper and a substrate are pressed together with heat. The image is transferred to the substrate at the high temperatures, the solid dye in solution converts to a gas without becoming a liquid (sublimation), and the gas disperses into pores of the substrate.

Screen printing consists of three elements: the screen which is the image carrier; a squeegee; and ink. The screen printing process uses a porous mesh stretched tightly over a frame made of wood or metal. Proper tension is essential for accurate color registration. The mesh is made of porous fabric or stainless steel mesh. A stencil is produced on the screen either manually or photochemically. The stencil defines the image to be printed, and in other printing technologies this would be referred to as the image plate.

Screen printing ink is applied to the substrate by placing the screen over the material. Ink with a paint-like consistency is placed onto the top of the screen. Ink is then forced through the fine mesh openings using a squeegee that is drawn across the screen, applying pressure and thereby forcing the ink through the open areas of the screen. Ink will pass through only in areas where no stencil is applied, thus forming an image on the printing substrate. The diameter of the threads and the thread count of the mesh will determine how much ink is deposited onto the substrates.

An appliqué comprises a first layer of a material, e.g., polyester or cotton or a mixture of both, which is attached to a second layer (on the bottom) of urethane through a heating process, applying 400 degrees F. (° F.) at about 40 to about 60 pounds (lbs.) for a period of 12 seconds. This undercoated material will be screen printed or sublimated (heat transforming an image using sublimation ink) by applying heat at 400° F. at 40 to 60 lbs. for 40 seconds. Finally a laser machine cuts around the image. This final product will be applied to different garments a subsequent heating process (400 F. degrees at 40 to 60 lbs. for 12 seconds).

FIG. 1 shows an appliqué 10 prior to assembly. A first layer 12 and a second layer 14 are shown. First layer 12 has a first graphic-bearing surface 16 and an opposed surface 18 to be adhered to second layer 14. Second layer 14 has first surface 20 which appends to surface 18 of first layer 12. Second layer 14 has a second surface 22 which is appended to a substrate (not shown) of a material, such as a garment.

Figure 2:
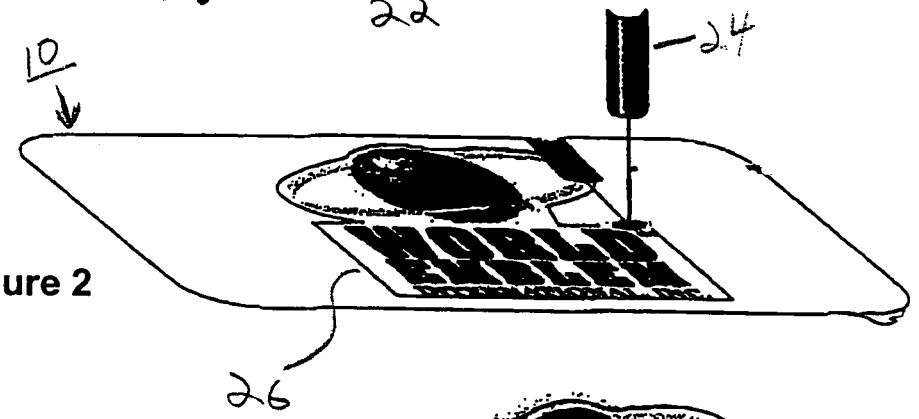
FIG. 2 is a perspective showing the appliqué of the present invention with an image applied thereto.
Figure 3:
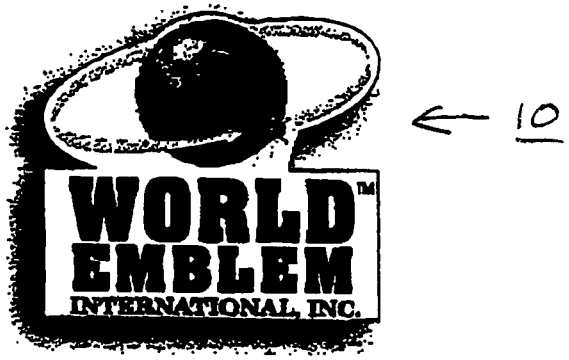
FIG. 3 is a drawing depicting the appliqué as applied to a substrate.

FIG. 2 shows an assembled appliqué 10. A laser 24 is used to cut around a graphic 26. FIG. 3 depicts appliqué 10 as it would look on a substrate, such as a garment.

While there have been described what are presently believed to be the preferred embodiments of the invention, those skilled in the art will realize that changes and modifications may be made thereto without departing from the spirit of the invention, and it is intended to include all such changes and modifications as fall within the true scope of the invention as defined by the claims.

What is claimed is:

1. A method of applying a graphic to a substrate comprising:

i) providing an appliqué comprising a first layer and a second layer of urethane bonded together, the first layer comprising polyester, cotton, or mixtures thereof;

ii) screen printing said graphic onto said first layer of said appliqué to imbed said graphic;

iii) cutting said appliqué around said imbedded graphic to remove portions of said appliqué not containing said imbedded graphic; and iv) applying said appliqué to said substrate at said second layer.

2. The method of claim 1 wherein said cutting is performed by a laser cutter.

3. The method of claim 2 wherein said appliqué is applied to said substrate by a thermal adhesion process.

4. A method of applying a graphic to a substrate comprising:

i) providing an appliqué comprising a first layer and a second layer of urethane bonded together, the first layer comprising polyester, cotton, or mixtures thereof;

ii) sublimating an inkjet paper graphic onto said first layer of said appliqué to imbed said graphic;

iii) cutting said appliqué around said imbedded graphic to remove portions of said appliqué not containing said imbedded graphic; and iv) applying said appliqué to said substrate at said second layer.

* * * * *